US011056811B2

(12) United States Patent
Masse et al.

(10) Patent No.: US 11,056,811 B2
(45) Date of Patent: Jul. 6, 2021

(54) UNIVERSAL CONNECTING MODULE FOR ELECTRICAL CONNECTOR, AND DATA-TRANSFERRING DEVICE COMPRISING SUCH A MODULE

(71) Applicant: Schneider Electric Industries SAS, Rueil Malmaison (FR)

(72) Inventors: Dominique Masse, Epinay sur Orge (FR); Brian Gallay, Sucy en Brie (FR); Sébastien Vitrant, Bois le Roi (FR); Cédric Chauvin, Bois le Roi (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 16/749,615

(22) Filed: Jan. 22, 2020

(65) Prior Publication Data

US 2020/0243994 A1 Jul. 30, 2020

(30) Foreign Application Priority Data

Jan. 29, 2019 (FR) ..... 1900790

(51) Int. Cl.

| | |
|---|---|
| ***H01R 12/75*** | (2011.01) |
| ***H01R 12/71*** | (2011.01) |
| ***H01R 13/506*** | (2006.01) |
| ***H01R 24/64*** | (2011.01) |
| ***H01R 43/26*** | (2006.01) |

(52) U.S. Cl.

CPC ..... *H01R 12/75* (2013.01); *H01R 12/714* (2013.01); *H01R 13/506* (2013.01); *H01R 24/64* (2013.01); *H01R 43/26* (2013.01)

(58) Field of Classification Search

CPC ..... H01R 43/042; H01R 13/6658; H01R 23/025; H01R 43/26; H01R 13/506; H01R 12/75; H01R 12/114; H01R 24/64

USPC ..... 439/76.1, 417, 404, 405

See application file for complete search history.

(56) References Cited

U.S. PATENT DOCUMENTS

| | | | | |
|---|---|---|---|---|
| 2009/0142968 A1* | 6/2009 | Goodrich | ..... | H01R 13/6658 439/676 |
| 2011/0028024 A1* | 2/2011 | Lu | ..... | H01R 4/2433 439/395 |
| 2012/0110837 A1* | 5/2012 | Slater | ..... | H01R 43/015 29/751 |
| 2013/0061470 A1* | 3/2013 | Matteo Ferrus | ..... | H01R 43/042 29/861 |

(Continued)

FOREIGN PATENT DOCUMENTS

| | | |
|---|---|---|
| DE | 102010021871 | 12/2010 |
| EP | 2806500 A1 | 11/2014 |

OTHER PUBLICATIONS

Search Report and Written Opinion for French Patent Application No. FR1900790 dated Oct. 17, 2019, 9 pages.

(Continued)

*Primary Examiner* — Gary F Paumen

(74) *Attorney, Agent, or Firm* — Locke Lord LLP

(57) ABSTRACT

A module for connecting a cable to an electrical connector. The module comprises connecting pins that are able to establish, as such, a contact between conductive wires of the cable and the tracks of a printed circuit board of the connector. A data-transferring device comprising such a module also is disclosed.

10 Claims, 9 Drawing Sheets

(56) References Cited

U.S. PATENT DOCUMENTS

| | | | | |
|---|---|---|---|---|
| 2014/0115890 | A1* | 5/2014 | Jonasson | H01R 43/042 29/863 |
| 2014/0273605 | A1* | 9/2014 | Chang | H01R 4/2433 439/391 |

OTHER PUBLICATIONS

English Language Machine Translation of German Patent Application Publication No. DE102010021871, published on Dec. 16, 2010, 49 pages.
Extended European Search Report for EP Application No. 20151641.6 dated Sep. 2, 2020, 10 pages.

* cited by examiner

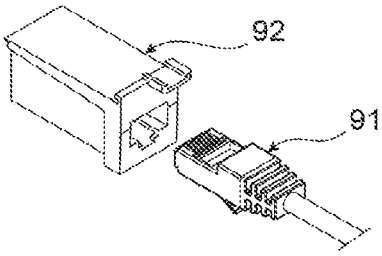
FIG. 1
Prior art
FIG. 2
Prior art
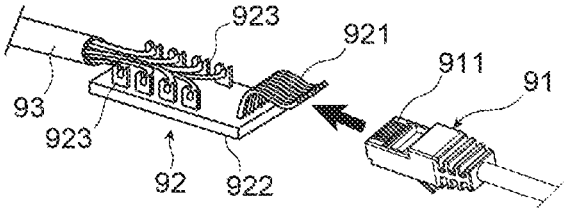
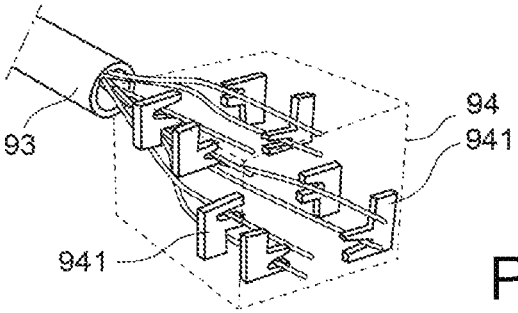
FIG. 3
Prior art

UNIVERSAL CONNECTING MODULE FOR ELECTRICAL CONNECTOR, AND DATA-TRANSFERRING DEVICE COMPRISING SUCH A MODULE

TECHNICAL FIELD

The invention relates to the field of data-transferring connectors or analogous, such as the connectors known by the name RJ45, or other types of analogous electrical connectors.

PRIOR ART

In the field of data transfer, the use of RJ45 connectors is very commonplace, these connectors having both a low cost and a noteworthy reliability.

With reference to FIG. 1, an RJ45 connector generally consists of a male connector 91 or female connector 92. When the connector 91 is male, the latter is intended to be plugged into a corresponding female connector 92.

Each connector 91/92 typically comprises contacts 911/921 that make mutual contact when the male connector 91 is plugged into the female connector 92 (see FIGS. 1 and 2).

In a first architecture that the female connector 92 may have, which architecture is illustrated in FIG. 2, said female connector comprises a printed circuit board 922 and connecting pins 923 that are fastened to the printed circuit board 922. The pins 923 allow the conductive wires of the cable 93 to be held and an electrical link to be established between these wires and the connection pins 921 of the connector 92, via tracks (not shown) of the printed circuit board 922.

In a second known architecture, which is illustrated in FIGS. 3 and 4, the cable 93 is connected to a module 94 intended to be assembled with a dedicated RJ45 connector 95. By dedicated connector, what is meant is a connector 95 comprising a member 951 for receiving such a module 94. In the example of FIG. 4, the connector 95 is female.

In the prior art, the module 94 typically comprises pins 941 intended, on the one hand, to hold the conductive wires of the cable 93 and, on the other hand, to establish an electrical link between these conductive wires and contact pads 952 provided in the receiving member 951 of the connector 95.

Such a module 94 allows the cable 93 to be successively connected to various types of connectors without modifying the connection of the conductive wires.

Such an architecture is relatively complex since the electrical link between the conductive wires of the cable 93 and the printed circuit board 953 of the connector 95 requires a plurality of contact parts, in the present case said pins 941 of the module 94 and said pads 952 of the connector 95.

The aim of the present invention is in particular to simplify the architecture of such a universal connecting device.

SUMMARY OF THE INVENTION

To this end, one subject of the invention is a module for connecting a cable to an electrical connector. The module of the invention comprises:

- a base comprising a mating face, this base being able to be placed in a contact position in which the mating face is facing tracks of a printed circuit board of the connector,

- connecting pins that are accommodated by the base, each pin comprising a first end that is arranged to receive a conductive wire of the cable and a second end that protrudes from said mating face so that a contact is established between the second end and a track of the printed circuit board when the base is in the contact position, the module comprising sidewalls perpendicular to the mating face and stops that are joined to these sidewalls, these stops being configured to interact with the printed circuit board so as to keep the base in the contact position.

Such a module allows an electrical contact to be established between one conductive wire of the cable and one track of the printed circuit board via a single part, in the present case one connecting pin.

This simplifies the architecture of the universal connecting module, improves the robustness of the module and limits manufacturing cost.

Furthermore, such an architecture allows the connection of the module to a connector to be simplified. The connection may be achieved using a single translational movement.

In one embodiment, the second end of each pin may be elastic so that, when the base is in the contact position, said second end exerts a force that keeps it in abutment against the corresponding track.

More generally, each pin may be arranged to establish a spring contact between the second end and the corresponding track when the base is in the contact position.

Preferably, the module may furthermore comprise a cover that interlocks with the base.

In one embodiment, the cover may comprise grooves each of which is arranged to receive one segment of one respective conductive wire.

Such a cover allows each conductive wire to be isolated from the others and facilitates assembly of the module.

Preferably, the cover may comprise housings that accommodate the first end of the pins so that, when the cover is interlocked with the base, the first end of each pin makes contact with one segment of one conductive wire accommodated in a corresponding groove.

Such an arrangement allows the establishment of a contact between each pin and the corresponding conductive wire to be optimized and guaranteed.

In one embodiment, the base may comprise an imprint facing the grooves of the cover so as to enclose the conductive wires in their respective groove.

Preferably, the first end of each pin comprises two arms that are arranged to grip one conductive wire of the cable.

In one embodiment, the base may comprise one or more elements for guiding and/or snap-fastening the module relatively to the connector, these elements being able to position and/or hold the base in the contact position.

Another subject of the invention is a data-transferring device comprising a male or female electrical connector, a cable, and a module such as defined above for connecting this cable to this connector.

Another subject of the invention is a tool configured to assemble the base and the cover of the module; and a method for interlocking the cover and the base by means of the tool.

BRIEF DESCRIPTION OF THE DRAWINGS

The detailed description that follows makes reference to the appended drawings, in which:

FIG. 1 is a perspective view of male and female connectors according to the prior art;

FIG. 2 is a schematic perspective view of portions of male and female connectors according to the prior art;

FIG. 3 is a schematic perspective view of a cable connected to connecting pins of a connector according to the prior art;

DETAILED DESCRIPTION OF EMBODIMENTS

Figure 4:
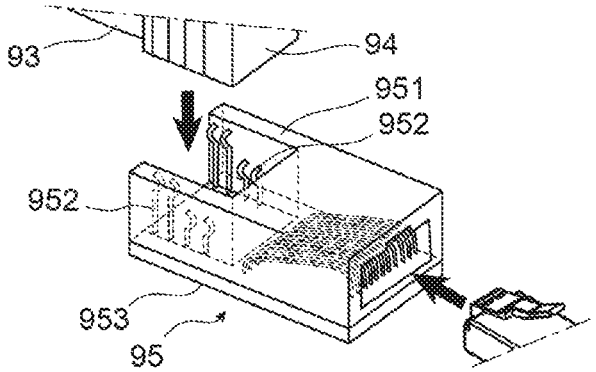
FIG. 4 Prior art
FIG. 4 is a schematic perspective view of portions of male and female connectors and of a connecting module according to the prior art.
Figure 5:
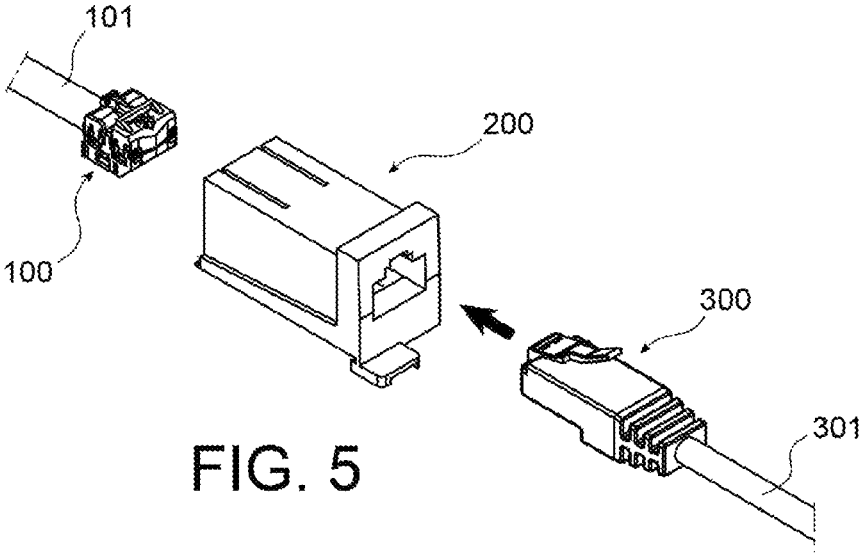
FIG. 5 is a schematic perspective view of male and female connectors and of a connecting module according to the invention.

FIG. 5 shows a data-transferring device according to the invention.

This device comprises a female RJ45 electrical connector 200 arranged to receive a corresponding male connector 300. When the connector 300 is plugged into the connector 200, electrical signals may be transferred therebetween via contacts (not shown) according to principles that are well known in the prior art. Such a connection typically allows data to be transferred from a cable 101 connected to one of these connectors 200 to a cable 301 connected to the other of these connectors 300.

This device has the particularity of comprising a module 100 for connecting the cable 101 to the connector 200 such as described below. The cable 101 is therefore in this case connected to the connector 200 indirectly, via the module 100.

Such a module 100 allows an operator to connect the cable 101 to various types of connectors without re-wiring. Specifically, such a module 100 may be connected to a connector 200, or be disconnected, without modification of the connection of the cable 101 to this module 100.

The invention more specifically relates to the architecture of the module 100. The invention is not however limited to a module 100 for connecting a cable 101 to a connector 200 of the type shown in FIG. 5. The connector 200 may consist of any other type of connector, in particular a male or female connector forming an RJ45, USB or any other type of interface, provided that this connector 200 comprises a printed circuit board able to receive or exchange electrical data with the module 100 according to the principles described below.

Of course, the invention also covers any data-transferring device comprising such a module 100.

Figure 6:
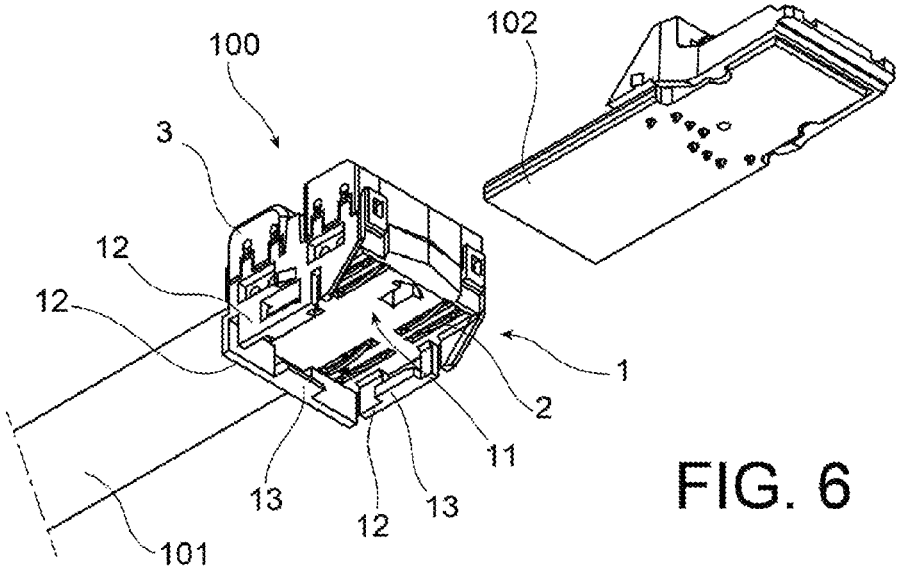
FIG. 6 is a schematic perspective view of a connector's printed circuit board and of a connecting module according to the invention.
Figure 7:
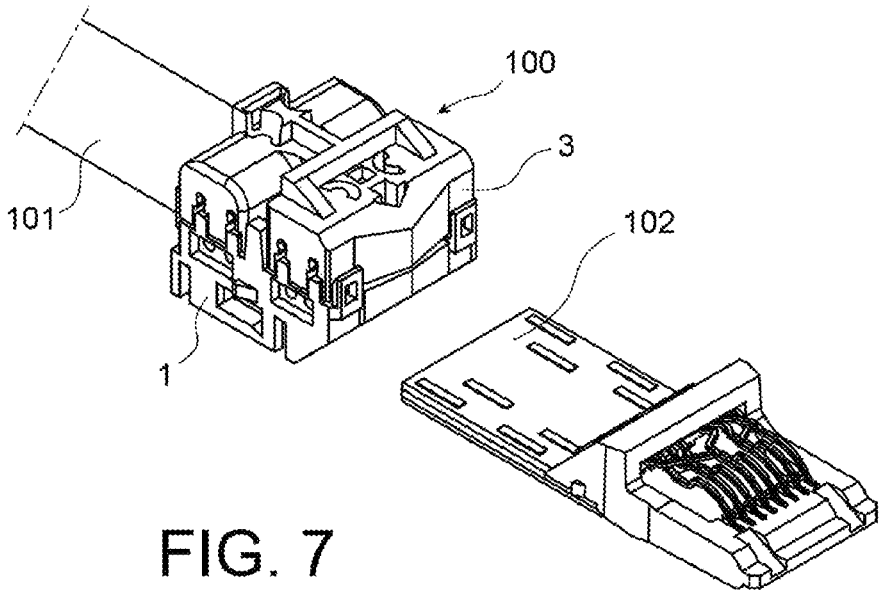
FIG. 7 is a schematic perspective view of a connecting module according to the invention.

FIGS. 6 and 7 show a module 100 according to the invention, a cable 101 connected to this module 100 and a printed circuit board 102 of a connector that consists in the connector 200 illustrated in FIG. 5. In these various figures, the printed circuit board 102 is shown detached from the module 100.

The module 100 and the printed circuit board 102 are intended to be securely fastened to each other so as to transfer data. To do this, the connector typically comprises a housing (not shown) able to receive the module 100 in a configuration permitting such a transfer of data.

In the example illustrated in FIGS. 6 to 9, the module 100 comprises a base 1, connecting pins 2 and a cover 3.

The base 1 comprises a mating face 11 (which may be seen in FIGS. 6, 8 and 9) intended to be located facing the printed circuit board 102 when the module 100 is plugged into the connector, in said configuration permitting a transfer of data between the module 100 and the printed circuit board 102 of the connector (see above).

More precisely, when the module 100 is plugged into the connector, the base 1 is placed in a contact position in which the mating face 11 is located facing tracks of the printed circuit board 102.

The base 1 is arranged to receive the pins 2, in particular within through-apertures that pass through the base 1 from the mating face 11 to an opposite face located facing the cover 3 (see FIGS. 8 and 9, and below).

Figure 8:
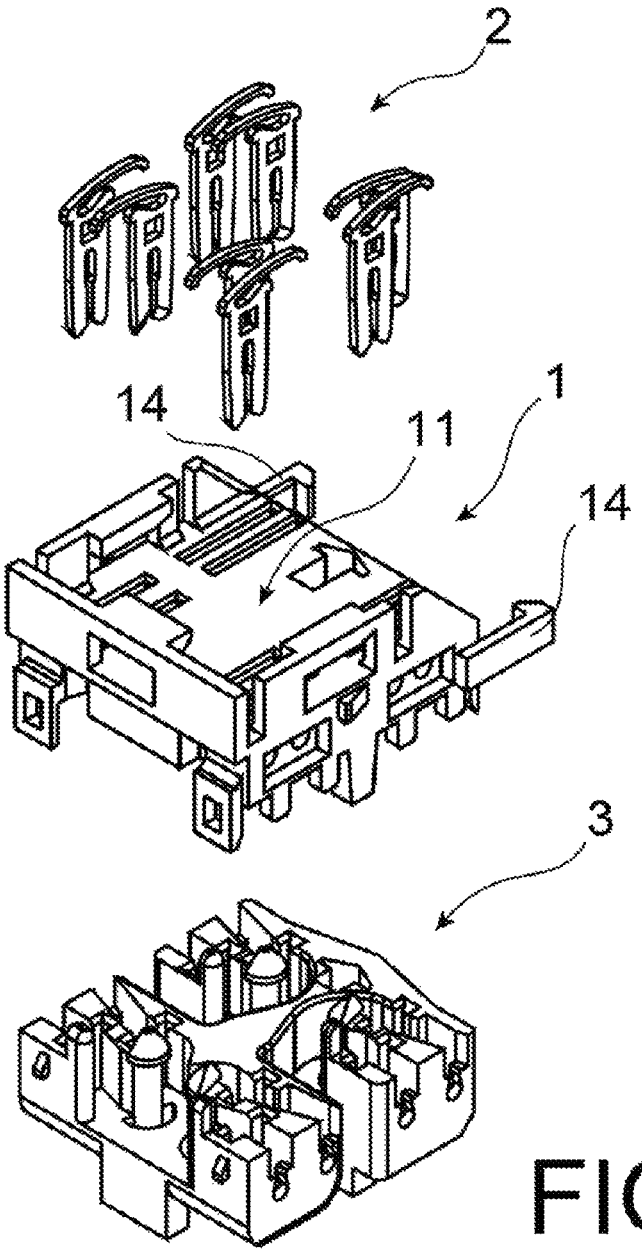
FIG. 8 is a schematic perspective exploded view showing pins and a base and a cover forming a connecting module according to the invention.
Figure 10:
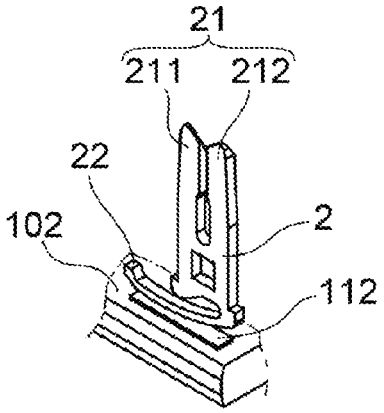
FIG. 10 is a schematic perspective view of a connector's printed circuit board and of a connecting pin of a module according to the invention.

A particular geometry that the pin 2 may have may be seen in FIGS. 8 and 10.

In this example, each pin 2 comprises a first end 21 formed by two arms 211 and 212 (see FIG. 10). These arms 211 and 212 are arranged to grip a conductive wire 111 of the cable 101.

Each pin 2 also comprises a second end 22, opposite to the first end 21. In this example, the second end 22 comprises an elastic tab, which is capable of deforming relatively to the first end 21.

A pin 2 with a geometry such as this allows the pin to be inserted into one of the apertures in the base 1 that are provided for this purpose, so that the second end 22 protrudes from the mating face 11, so as to establish a contact between the second end 22 and a track 112 of the printed circuit board 102 when the base 1 is in the contact position.

With reference to FIG. 10, it may be seen that such a pin 2 allows, by virtue of its geometry, a spring contact to be established between its second end 22 and a corresponding track 112 when the base 1 is in the contact position.

In other words, the elasticity conferred by the geometry of the pin 2, in particular the presence of a tab forming its second end 22, allows the latter to exert a force that keeps it in abutment against the track 112 when the base 1 is in the contact position.

In order in particular to protect the conductive wires 111 of the cable 101, the base 1 is surmounted by the cover 1 so as to form, together, a casing in which the conductive wires 111 are enclosed.

Figure 9:
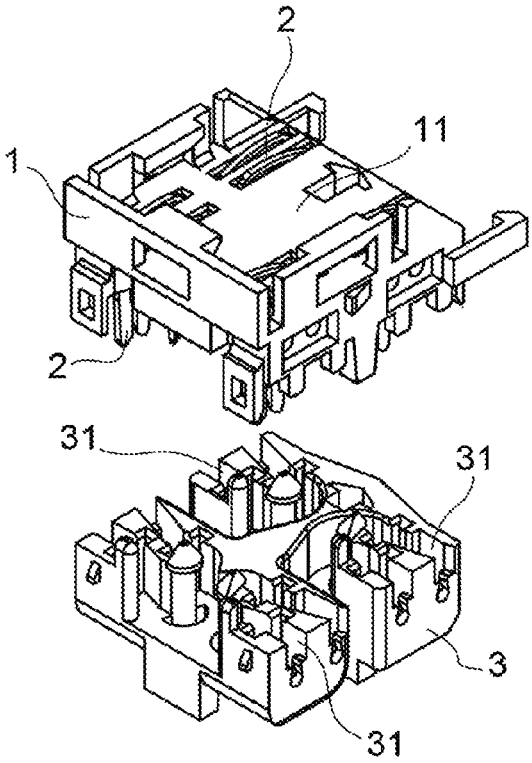
FIG. 9 is a schematic perspective exploded view showing the base bearing the pins, and the cover of the connecting module according to the invention.
Figure 11:
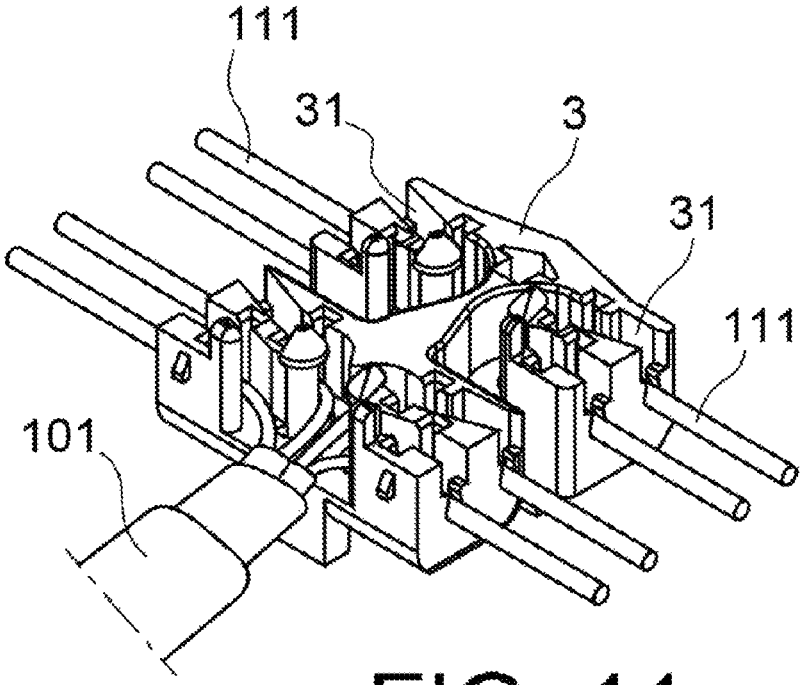
FIG. 11 is a schematic perspective view of a cable connected to a cover of a connecting module according to the invention.

With reference to FIGS. 9 and 11, the cover 3 comprises grooves 31 each of which is arranged to receive one segment of one respective conductive wire 111.

The cover 3 and the base 1 are assembled after the conductive wires 111 have been placed in their respective groove 31 in a configuration such as that illustrated in FIG. 11. From such a configuration, the base 1 equipped with the pins 2 see FIG. 9 which shows the base 1 with the pins 2 in their respective aperture is assembled with the cover 3.

The base 1 preferably comprises an imprint facing the grooves 31 of the cover 3 so as to close the grooves 31 and/or to enclose the conductive wires 111 in their respective groove 31 when the base 1 and the cover 3 are assembled. Alternatively, the imprint may be replaced by a face of any geometry, of planar geometry for example.

As may be seen in FIG. 9, the first end 21 of the pins 2 protrudes from the face of the base 1 located facing the cover 3, thus allowing them to be brought into contact with the conductive wires 111.

In this respect, the cover 3 preferably comprises housings arranged to receive the first end of the pins 2 so that, when the cover 3 is assembled with the base 1, the first end of each pin 2 makes contact with one segment of one conductive wire 111 accommodated in one corresponding groove 31.

Thus, during the assembly of the base 1 with the cover 3, the arms 211 and 212 of each pin 2 are simultaneously housed in the corresponding housings of the cover 3 and grip a conductive wire 111 located in the corresponding groove 31.

Such a module 100 therefore allows a contact to be established between the cable 101 and the printed circuit board 102 via the pins 2 the second end 22 of which makes contact with the tracks 112 of the printed circuit board 102 when the base 1 is in the contact position.

In order to place the base 1 in the contact position, the latter may comprise one or more elements for guiding and/or snap-fastening the module 100 relatively to the connector. One advantageous function of such guiding and/or snap-fastening elements is to position and/or hold the base 1 in the contact position.

In the example of the embodiment in FIG. 6, the base 1 comprises sidewalls 12 perpendicular to the mating face 11. These sidewalls 12 form guiding elements allowing the base 1 to be positioned so as to place the second end 22 of the pins 2 facing the tracks 112 of the printed circuit board 102.

The printed circuit board 102 is inserted via a translational movement with respect to the mating face 11, and more particularly by sliding one with respect to the other, in order to be placed in the contact position. The translational movement is made perpendicular to the orientation of the pins 2 (orientation defined by the direction passing through the first end 21 and the second end 22 of the pins 2). Such a movement is particularly simple to make, and ensures a satisfactory contact to the connector 200.

In this example, the base 1 also comprises stops 13 that are joined to the sidewalls 12. These stops 13 are arranged to hold the printed circuit board 102 against the mating face 11 when the base 1 is in the contact position. More particularly, the stops 13 are configured to interact, in particular by contact, with the printed circuit board 102 so as to hold the base 1 in the contact position.

Thus, in the contact position, the printed circuit board 102 is interposed between the stops 13 and the second end 22 of the pins 2. The stops 13 are more particularly configured to allow a contact, in particular a fixed contact, between the second end 22 of the pins 2 and the tracks 112 of the printed circuit board 102. The elastic or spring function of the pins 2 such as described above allows the printed circuit board 102 to be held compressed against the stops 13.

With reference to FIG. 8, the base 1 may comprise fingers 14 allowing a plurality of modules 100 to be assembled one after the other in order to facilitate the transportation thereof. These fingers 14 are preferably arranged to be inserted into the tool 40 (see below) like a block of staples is inserted into a stapler.

Figure 12:
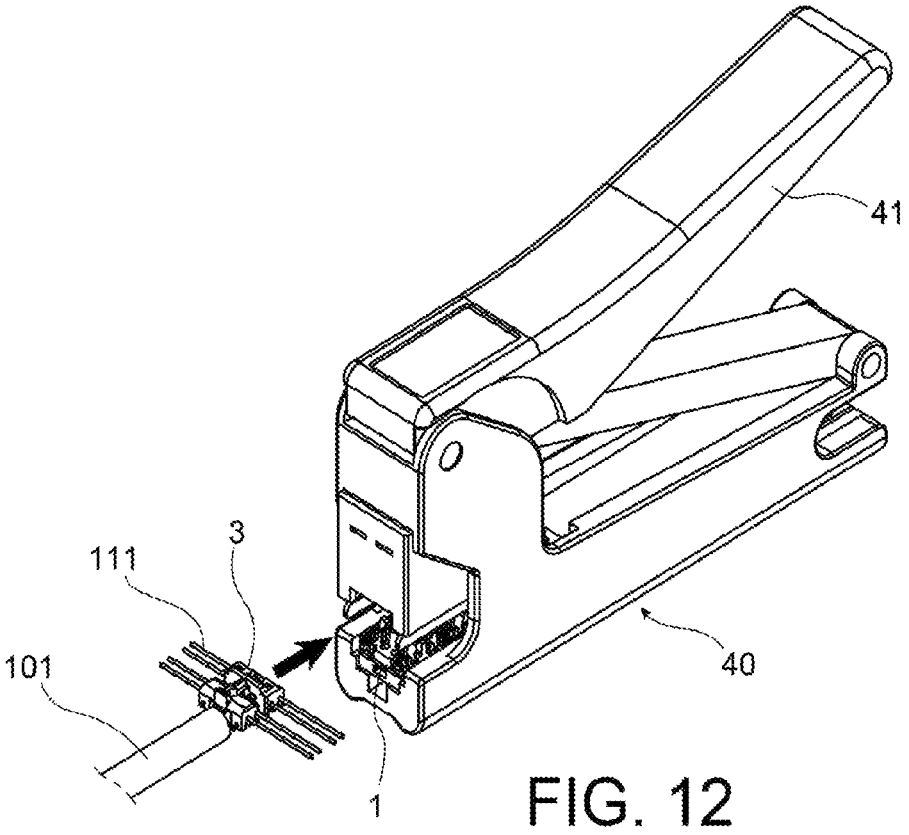
FIG. 12 is a schematic perspective view of a tool for assembling a connecting module according to the invention, showing the module before assembly of a base and of a cover.

With reference to FIG. 12, the assembly of data-transferring devices according to the invention may be facilitated using a tool 40 configured to assemble a base 1 and a cover 3, and more precisely a base 1 equipped with pins 2 and a cover 3 accommodating the conductive wires 111 of a cable 101 according to the principle illustrated in FIG. 11.

Figure 13:
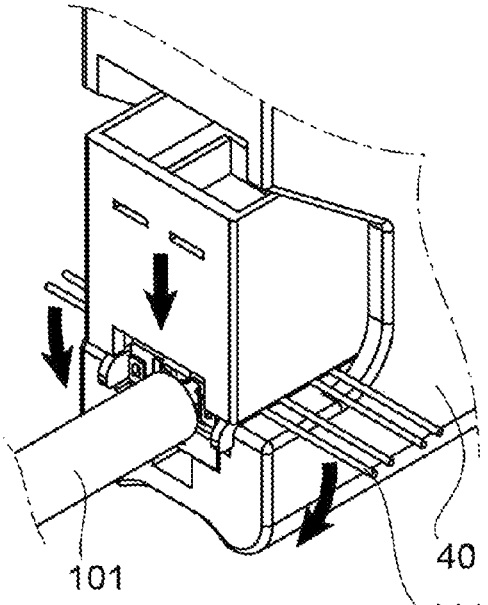
FIG. 13 is a schematic perspective view of the assembling tool, showing the module in the process of assembly.
Figure 14:
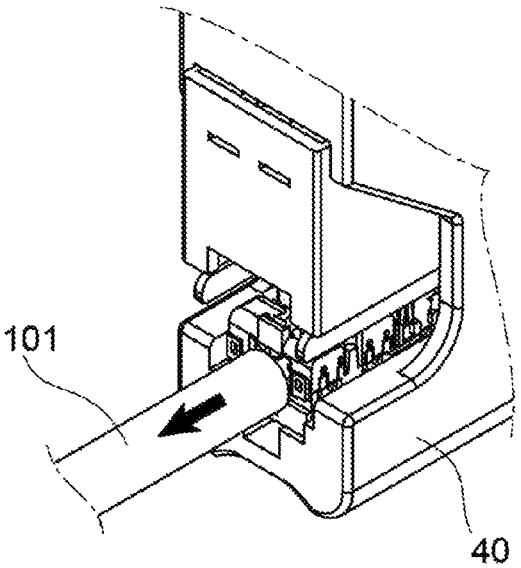
FIG. 14 is a schematic perspective view of the assembling tool, showing the module after assembly of the base and of the cover.

FIGS. 12 to 14 show an assembling sequence using such a tool 40.

A base 1 equipped with pins 2 is firstly placed in the tool 40; separately, for example beforehand, the conductive wires 111 of a cable 101 are placed in the grooves of a cover 3 (FIG. 12).

The cover 3 accommodating the conductive wires 111 is then inserted into the tool 40 facing the base 1 (FIG. 13).

The tool 40 comprises, to this end, elements for accommodating the base 1 and the cover 3 between the respective jaws of the tool 40.

After the base 1 and the cover 3 have been placed between the jaws of the tool 40, the latter is actuated, typically using a lever 41 (shown in FIG. 12). The actuation of the tool 40 allows the cover 3 to be pressed against the base 1 and said cover and base to be assembled. In this operation, the segment of the conductive wires 111 that protrudes from the grooves 31 out of the cover 3 (segment of the wires 111 visible in FIG. 11) and the fingers 14 are simultaneously cut by a cutting member of the tool 40 (see FIGS. 13 and 14).

The assembling sequence that has just been described allows a sub-assembly made up of a module 100 and a cable 101 to be obtained, which sub-assembly may be employed in a data-transferring device according to the invention.

Figure 15:
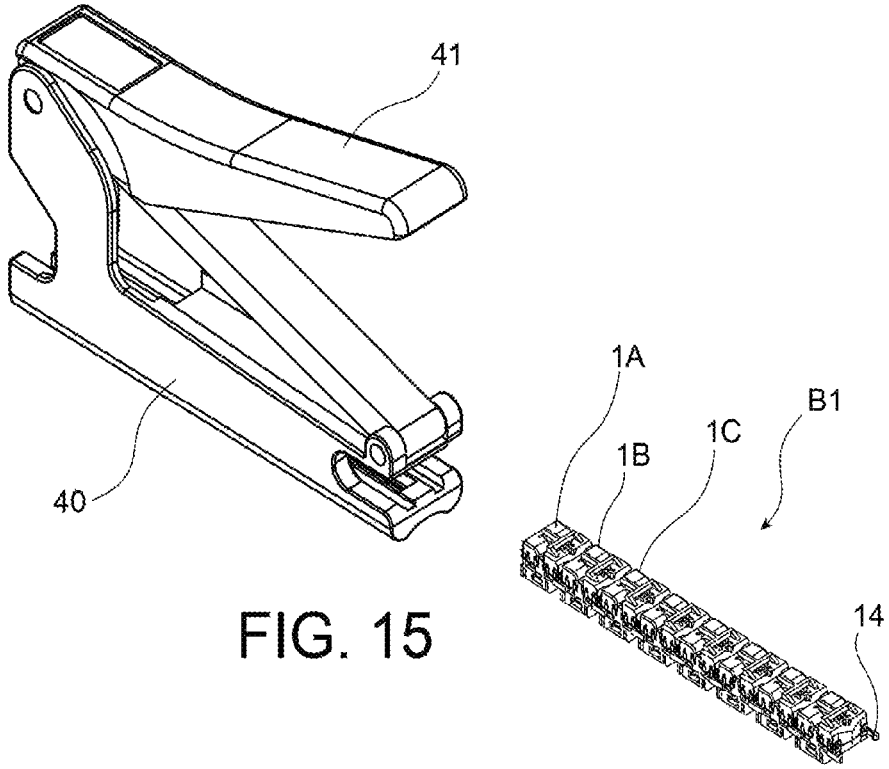
FIG. 15 is a schematic perspective view of the assembling tool, showing a strip of a plurality of bases.

The assembly may be optimized by pre-assembling a series of bases 1A, 1B, 1C . . . to form a strip B1 (see FIG. 15). Two adjacent bases 1A, 1B, 1C . . . may be assembled using the fingers 14.

With reference to FIG. 15, such a strip B1 is inserted into a magazine of the tool 40 after each base 1A, 1B, 1C . . . has been equipped with connecting pins.

In this case, during the actuation of the tool 40, a cover is assembled with the base 1A located between the jaws of the tool 40 and this base 1A is detached from the bases 1B, 1C . . . of the strip B1 by cutting through the two fingers 14.

Regarding functions of the tool 40 that have not been described, the latter may operate similarly to a desktop stapler.

The invention claimed is:

1. Module for connecting a cable to an electrical connector, comprising:

a base comprising a mating face, the base being able to be placed in a contact position in which the mating face is facing tracks of a printed circuit board of the connector, connecting pins that are accommodated by the base, each pin comprising a first end that is arranged to receive a conductive wire of the cable and a second end that protrudes from said mating face so that a contact is established between the second end and a track of the printed circuit board when the base is in the contact position, and sidewalls perpendicular to the mating face and stops that protrude from interior surfaces of the sidewalls, the stops being configured to interact with the printed circuit board in response to translational movement of the printed circuit board and/or the mating face, one with respect to the other, along a direction perpendicular to a direction passing through the first end and the second end of each connecting pin so as to keep the base in the contact position.

2. Module according to claim 1, wherein the second end of each pin is elastic so that, when the base is in the contact position, said second end exerts a force that keeps it in abutment against the corresponding track.

3. Module according to claim 1, wherein each pin is arranged to establish a spring contact between the second end and the corresponding track when the base is in the contact position.

4. Module according to claim 1, further comprising a cover that interlocks with the base, the cover comprising grooves each of which is arranged to receive one segment of one respective conductive wire.

5. Module according to claim 4, wherein the cover comprises housings that accommodate the first end of the pins so that, when the cover is interlocked with the base, the first end of each pin makes contact with one segment of one conductive wire accommodated in a corresponding groove.

6. Module according to claim 4, wherein the base comprises an imprint facing the grooves of the cover so as to enclose the conductive wires in their respective groove.

7. Module according to claim 1, wherein the first end of each pin comprises two arms that are arranged to grip one conductive wire of the cable.

8. Data-transferring device comprising a male or female electrical connector and a cable, the device further comprising a module for connecting the cable to the connector according to claim 1.

9. Tool configured to interlock the base and the cover of the module according to claim 4, comprising jaws configured to receive the base and the cover, respectively.

10. Method for interlocking the cover and the base by means of the tool according to claim 9, comprising at least:

placing the base and the cover between the jaws of the tool; and actuating the tool so as to interlock the cover against the base.

* * * * *